US012607365B2

(12) United States Patent
Holtdirk

(10) Patent No.: US 12,607,365 B2
(45) Date of Patent: Apr. 21, 2026

(54) COOKING DEVICE MUFFLE FOR A COOKING DEVICE AND COOKING DEVICE HAVING A COOKING DEVICE MUFFLE

(71) Applicant: Miele & Cie. KG, Guetersloh (DE)

(72) Inventor: Hans-Gerd Holtdirk, Lippstadt (DE)

(73) Assignee: Miele & Cie. KG, Guetersloh (DE)

( * ) Notice: Subject to any disclaimer, the term of this patent is extended or adjusted under 35 U.S.C. 154(b) by 406 days.

(21) Appl. No.: 18/333,558

(22) Filed: Jun. 13, 2023

(65) Prior Publication Data

US 2023/0408109 A1 Dec. 21, 2023

(30) Foreign Application Priority Data

Jun. 21, 2022 (DE) ..... 10 2022 115 346.0

(51) Int. Cl.
*F24C 15/36* (2006.01)

(52) U.S. Cl.
CPC ..... *F24C 15/36* (2013.01)

(58) Field of Classification Search
CPC ..... F24C 15/36
USPC ..... 126/1 R, 273 R, 348, 369, 20, 405–407; 137/527, 529
See application file for complete search history.

(56) References Cited

U.S. PATENT DOCUMENTS 3,217,736 A * 11/1965 Waldemar ..... F16K 15/028 137/343
2014/0322416 A1* 10/2014 Sanseverino ..... A23L 5/15 219/400

FOREIGN PATENT DOCUMENTS

| | | |
|---|---|---|
| DE | 7732919 U | 2/1978 |
| EP | 0624759 A1 | 11/1994 |
| EP | 2994697 B1 | 2/2019 |

* cited by examiner

*Primary Examiner* — Vivek K Shirsat
(74) *Attorney, Agent, or Firm* — Leydig, Voit & Mayer, Ltd.

(57) ABSTRACT

A cooking device muffle for a cooking device includes: a cooking chamber having a cooking chamber opening tightly closable by a door of the cooking device, and at least one cooking chamber wall for delimiting the cooking chamber. The cooking device muffle is suitable for explosion testing. A pressure compensation opening is arranged in one cooking chamber wall of the at least one cooking chamber wall to dissipate an explosion pressure generated during an explosion test, the pressure compensation opening being tightly closed by a purely mechanical closing device of the cooking device muffle in a normal state of the cooking device muffle, in which a cooking chamber pressure lower than the explosion pressure prevails in the cooking device muffle. The closing device automatically opens the pressure compensation opening at a cooking chamber pressure greater than or equal to the explosion pressure and automatically tightly closes the pressure compensation opening.

9 Claims, 6 Drawing Sheets

COOKING DEVICE MUFFLE FOR A COOKING DEVICE AND COOKING DEVICE HAVING A COOKING DEVICE MUFFLE

CROSS-REFERENCE TO PRIOR APPLICATION

Priority is claimed to German Patent Application No. DE 10 2022 115 346.0, filed on Jun. 21, 2022, the entire disclosure of which is hereby incorporated by reference herein.

FIELD

The invention relates to a cooking device muffle for a cooking device and to a cooking device having a cooking device muffle.

BACKGROUND

Cooking device muffles for cooking devices and cooking devices having cooking device muffles are known from the prior art in a large number of designs. The known cooking device muffles comprise, for example, a cooking chamber having a cooking chamber opening that is tightly closable by means of a door of the cooking device and at least one cooking chamber wall for delimiting the cooking chamber, the cooking device muffle being designed to be suitable for explosion testing. An explosion test suitability of cooking device muffles and cooking devices equipped therewith is mandatory, for example, for products for the North American market, as these products are subjected to an explosion test for the purpose of approval.

SUMMARY

In an embodiment, the present invention provides a cooking device muffle for a cooking device, comprising: a cooking chamber having a cooking chamber opening tightly closable by a door of the cooking device, and at least one cooking chamber wall for delimiting the cooking chamber, wherein the cooking device muffle is configured for explosion testing, wherein a pressure compensation opening is arranged in one cooking chamber wall of the at least one cooking chamber wall to dissipate an explosion pressure generated during an explosion test, the pressure compensation opening being tightly closed by a purely mechanical closing device of the cooking device muffle in a normal state of the cooking device muffle, in which a cooking chamber pressure lower than the explosion pressure prevails in the cooking device muffle, and wherein the closing device is configured to automatically open the pressure compensation opening at a cooking chamber pressure greater than or equal to the explosion pressure and automatically tightly close the pressure compensation opening again after the cooking chamber pressure drops to a value below the explosion pressure.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1A:
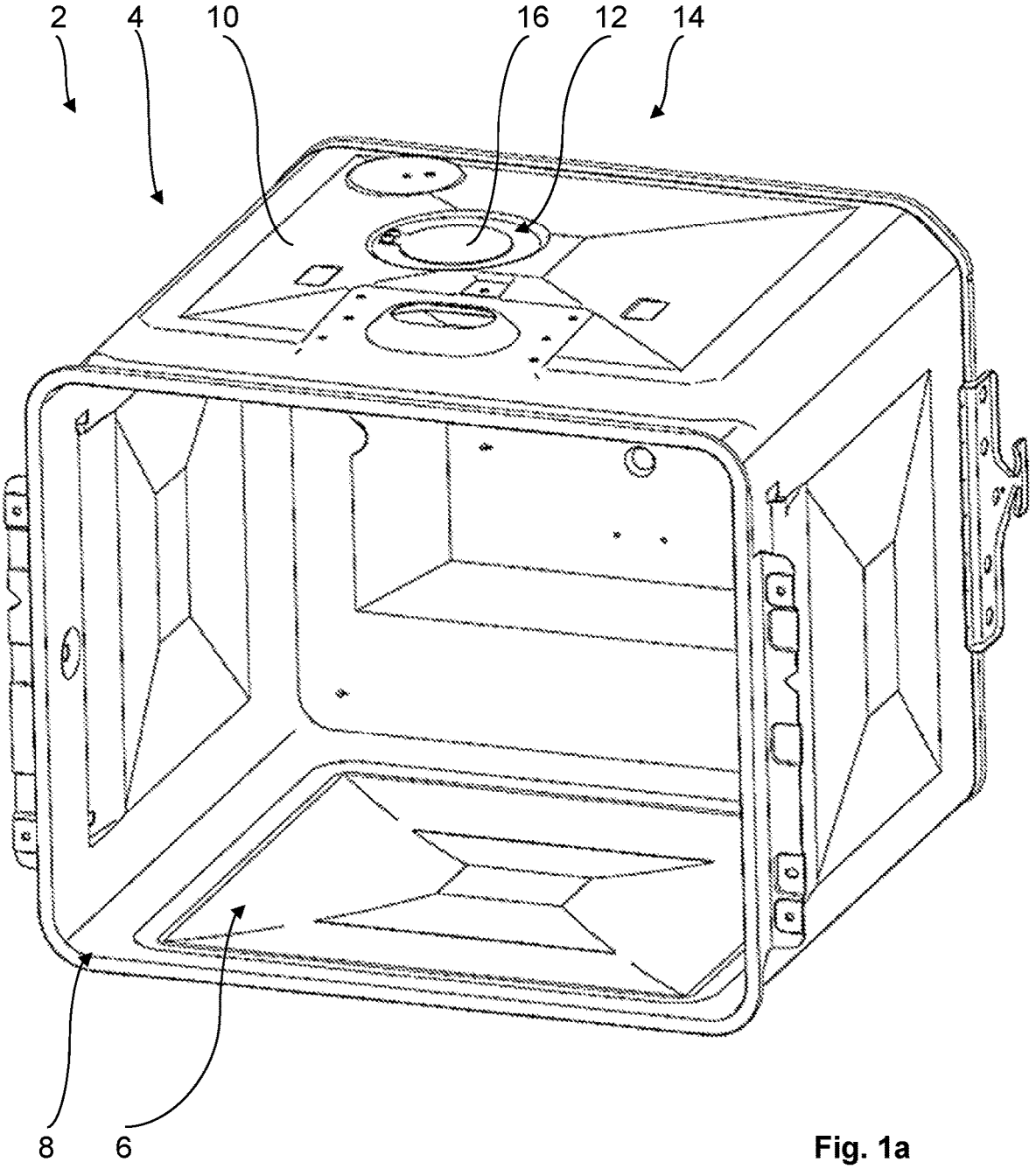
FIG. 1*a* shows a first exemplary embodiment of the cooking device according to the invention having the cooking device muffle according to the invention in a partial, perspective view, without the stop.
Figure 1B:
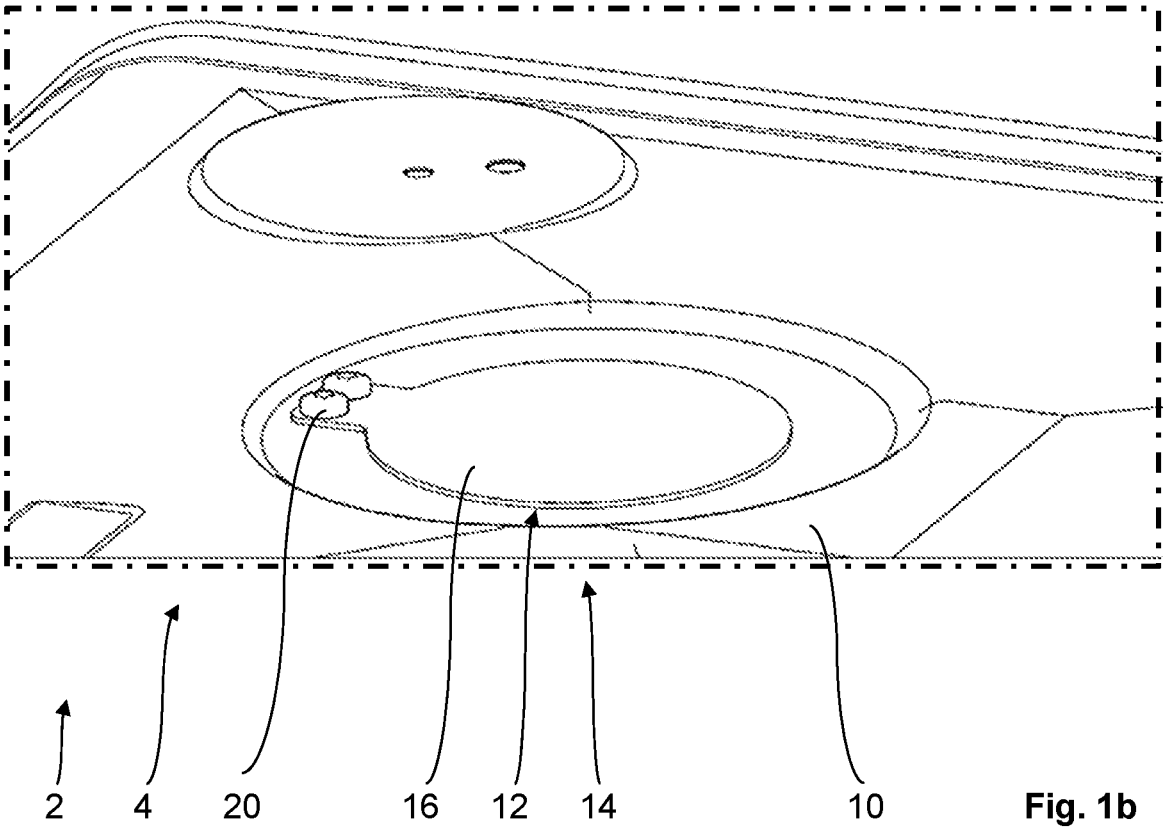
FIG. 1*b* shows the first embodiment according to FIG. 1*a* in an enlarged detail view in the region of the pressure compensation opening, in perspective view, without the stop.
Figure 2A:
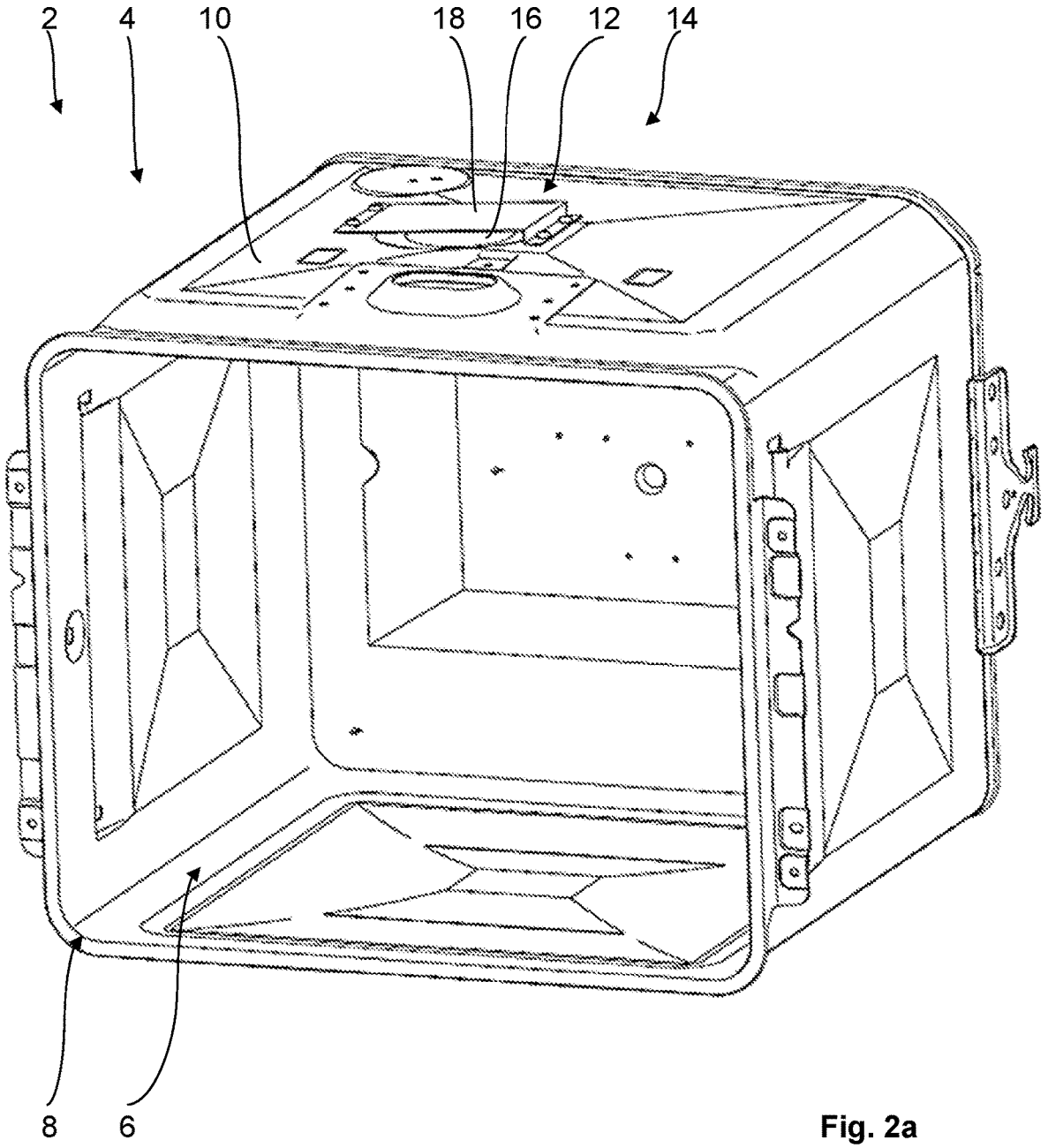
FIG. 2*a* shows the first exemplary embodiment in an analogous representation to FIG. 1*a*, with the stop.
Figure 2B:
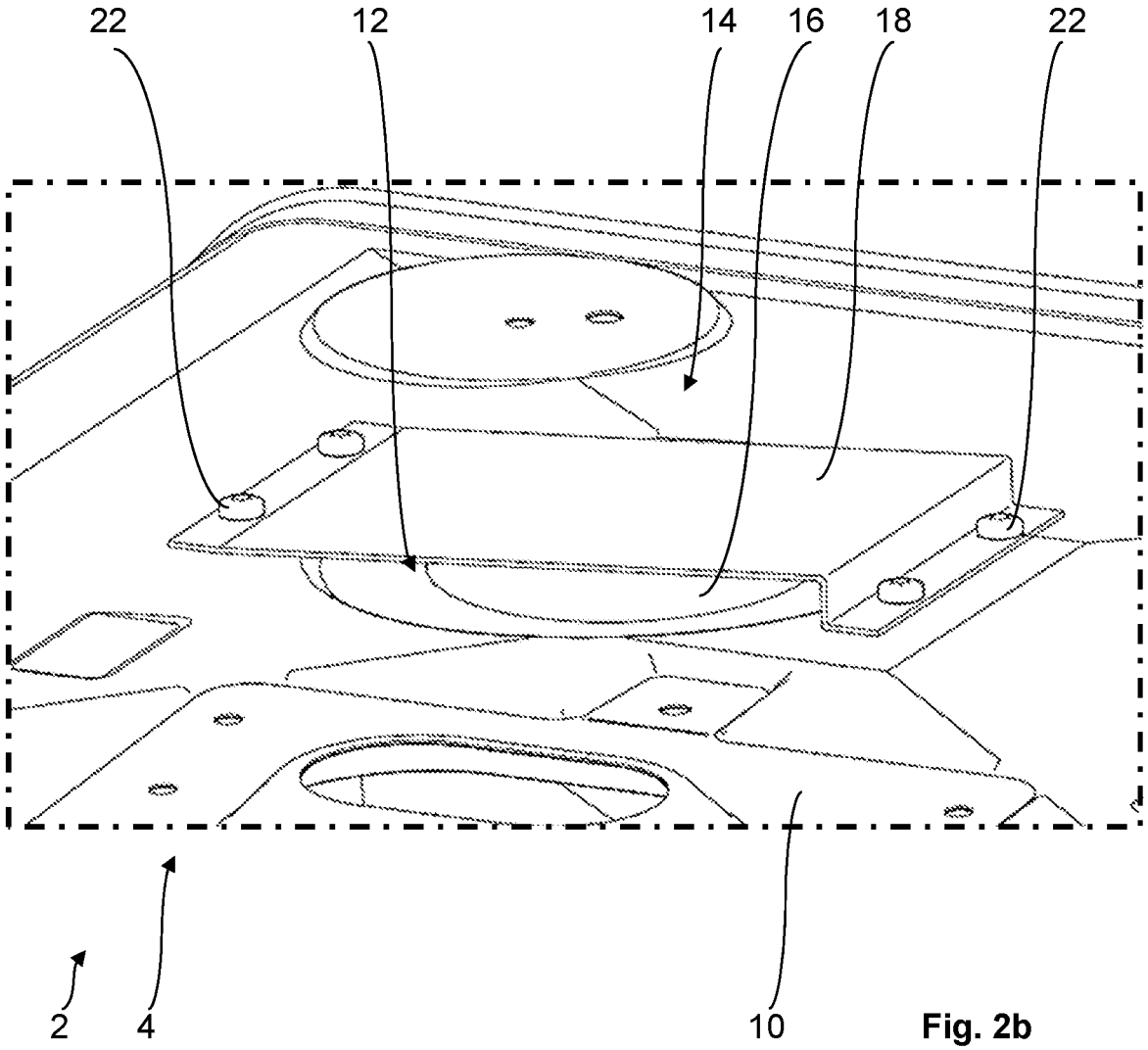
FIG. 2*b* shows the first exemplary embodiment in an analogous representation to FIG. 1*b*, with the stop.

In an embodiment, the present invention improves a cooking device muffle for a cooking device and a cooking device having a cooking device muffle.

In an embodiment, the present invention provides a cooking device muffle for a cooking device having the features described herein, which is wherein a pressure compensation opening is arranged in one of the at least one cooking chamber wall for dissipating an explosion pressure generated during an explosion test, the pressure compensation opening being tightly closed by means of a purely mechanical closing device of the cooking device muffle in a normal state of the cooking device muffle, in which a cooking chamber pressure lower than the explosion pressure prevails in the cooking device muffle, and the closing device being designed and arranged in such a way that the closing device automatically opens the pressure compensation opening at a cooking chamber pressure greater than or equal to the explosion pressure and automatically tightly closes the pressure compensation opening again after the cooking chamber pressure drops to a value below the explosion pressure. In addition, in an embodiment, the present invention provides a cooking device having a cooking device muffle having the features described herein.

In particular, an advantage achievable by the invention is that a cooking device muffle for a cooking device and a cooking device having a cooking device muffle are improved. Due to the design according to the invention of the cooking device muffle for a cooking device and of the cooking device having a cooking device muffle, the explosion test suitability of the cooking device muffle and of the cooking device equipped therewith can be realized in a particularly simple and robust manner in terms of design and production technology. Accordingly, the cooking device muffle and the cooking device equipped therewith can be manufactured at considerably lower cost. By means of the invention, the explosion test suitability is reliably ensured, so that damage or preliminary damage to the cooking device muffle and/or to a remainder of the cooking device is effectively prevented. For example, the explosion pressure associated with the explosion test can thus be kept away from the door of the cooking device by means of which the cooking chamber opening can be closed.

In principle, the cooking device muffle according to the invention for a cooking device and the cooking device according to the invention equipped therewith can be freely selected in terms of type, mode of operation, material and dimensioning, within wide suitable limits. For example, the cooking device according to the invention can be designed as an oven, a steam cooking device, a microwave device or as a combination device having a plurality of heating modes that are different from each other. Furthermore, the cooking device according to the invention may be designed as a household cooking device or as a commercial cooking device, i.e. a cooking device for professional use. In addition, the cooking device according to the invention can conceivably be designed as a so-called pyrolysis device, i.e. a device having a self-cleaning function. The design of the cooking device muffle for a cooking device according to the invention is correspondingly diverse. For example, the arrangement, the shape, and the dimensions of the pressure compensation opening can be freely selected within wide suitable limits. The pressure compensation opening is expediently arranged above the cooking chamber, preferably centrally above the cooking chamber. It is also useful for the pressure compensation opening to be situated in a raised position on the cooking device muffle relative to a remainder of the cooking device muffle surrounding the pressure compensation opening. In this way, a good and thus tight seating of the closing device on the pressure compensation opening is ensured.

An advantageous development, or embodiment, of the cooking device muffle according to the invention for a cooking device provides that the closing device has a closure cover fastened to a remainder of the cooking device muffle for closing the pressure compensation opening in the normal state of the cooking device muffle and has a stop fastened to the remainder of the cooking device muffle, the closure cover and the stop being designed and arranged so as to be matched to one another in such a way that the closure cover tightly closes the pressure compensation opening again automatically by means of a spring return force of the closure cover after the cooking chamber pressure drops to a value below the explosion pressure. As a result, the purely mechanical closing device can be realized in a very simple and robust manner.

An advantageous development of the aforementioned embodiment of the cooking device muffle for a cooking device according to the invention provides that the closure cover is designed as a spring tongue clamped on one side and having a clamping end and a free end. In this way, the closure cover can be realized particularly easily in terms of design and production.

An advantageous development of the two last-mentioned embodiments of the cooking device muffle according to the invention for a cooking device provides that the stop is formed as a bracket spanning the pressure compensation opening and the closure cover and clamped on both sides, preferably that the bracket rises continuously by a predetermined angular value from a first clamping end of the bracket to a second clamping end of the bracket opposite this first clamping end, the first clamping end of the bracket being located on the same side of the pressure compensation opening as the clamping end of the spring tongue clamped on one side. As a result, the stop can also be realized in a particularly simple manner in terms of design and production.

An advantageous further development of the cooking device muffle according to an embodiment provides that the stop comprises a plurality of through-openings on a side of the stop opposite the pressure compensation opening, preferably that the plurality of through-openings is uniformly distributed over the entire aforementioned side of the stop, particularly preferably that a total area of the through-openings corresponds to at least 10% of a total area of the aforementioned side of the stop. In this way, it is made possible on the one hand that the flow of the explosion gases escaping from the cooking chamber by means of the pressure compensation opening is hindered as little as possible by the stop according to the aforementioned development of the cooking device muffle according to the invention. On the other hand, a saving in terms of material and weight, as well as an associated additional cost saving, is hereby made possible. The aforementioned advantages apply to various embodiments of the invention.

Another advantageous development of the cooking device muffle according to the invention for a cooking device provides that the explosion pressure for which the closing device is designed is greater than or equal to 10 mbar. As a result, an explosion pressure which is particularly suitable for the design of the closing device is defined.

In FIG. 1*a* to 2*b*, a first exemplary embodiment of the cooking device according to the invention having the cooking device muffle according to the invention is shown purely as an example.

The cooking device 2, designed as a household oven, comprises, among other things, a cooking device muffle 4. The cooking device muffle 4 comprises a cooking chamber 6 having a cooking chamber opening 8 which is tightly closable by means of a door of the cooking device 2 and at least one cooking chamber wall 10 for delimiting the cooking chamber 6, the cooking device muffle 4 being designed to be suitable for explosion testing.

According to the invention, in one of the at least one cooking chamber wall 10, namely above cooking chamber 6, a pressure compensation opening 12 is arranged for dissipating an explosion pressure generated during an explosion test, the pressure compensation opening 12 being tightly closed by means of a purely mechanical closing device 14 of the cooking device muffle 4 in a normal state shown in FIG. 1*a* to 2*b* of the cooking device muffle 4, in which a cooking chamber pressure lower than the explosion pressure prevails in the cooking device muffle 4, and the closing device 14 being designed and arranged in such a way that the closing device 14 automatically opens the pressure compensation opening 12 at a cooking chamber pressure greater than or equal to the explosion pressure and automatically tightly closes the pressure compensation opening 12 again after the cooking chamber pressure drops to a value below the explosion pressure. The explosion pressure for which the closing device 14 is designed in the present exemplary embodiment is defined here as a pressure value of 10 mbar.

The closing device 14 has a closure cover 16 fastened to a remainder of the cooking device muffle 4 for closing the pressure compensation opening 12 in the normal state of the cooking device muffle 4 and a stop 18 fastened to the remainder of the cooking device muffle 4, the closure cover 16 and the stop 18 being designed and arranged so as to be matched to one another in such a way that the closure cover 16 tightly closes the pressure compensation opening 12 again automatically by means of a spring return force of the closure cover 16 after the cooking chamber pressure drops to a value below the explosion pressure.

In the present exemplary embodiment, the closure cover 16 is designed as a spring tongue clamped on one side, having a clamping end and a free end, the closure cover 16 being fastened at its clamping end to the remainder of the cooking device muffle 4 by means of two screws 20. However, any other reasonable and suitable connection technique is also conceivable for the purpose of realizing the aforementioned clamping end.

Here, the stop 18 is designed as a bracket that spans the pressure compensation opening 12 and the closure cover 16 and is clamped on both sides, the bracket 18 rising continuously by a predetermined angular value from a first clamping end of the bracket 18 to a second clamping end of the bracket 18 opposite this first clamping end, the first clamping end of the bracket 18 lying on the same side of the pressure compensation opening 12 as the clamping end of the spring tongue 16 clamped on one side. Analogously to the closure cover 16 designed as a spring tongue, the stop 18 designed as a bracket is fastened to the remainder of the cooking device muffle 4 by means of four screws 22. Of course, in this case too, any other useful and suitable connection technique is conceivable for the purpose of realizing the aforementioned clamping ends.

Figure 3A:
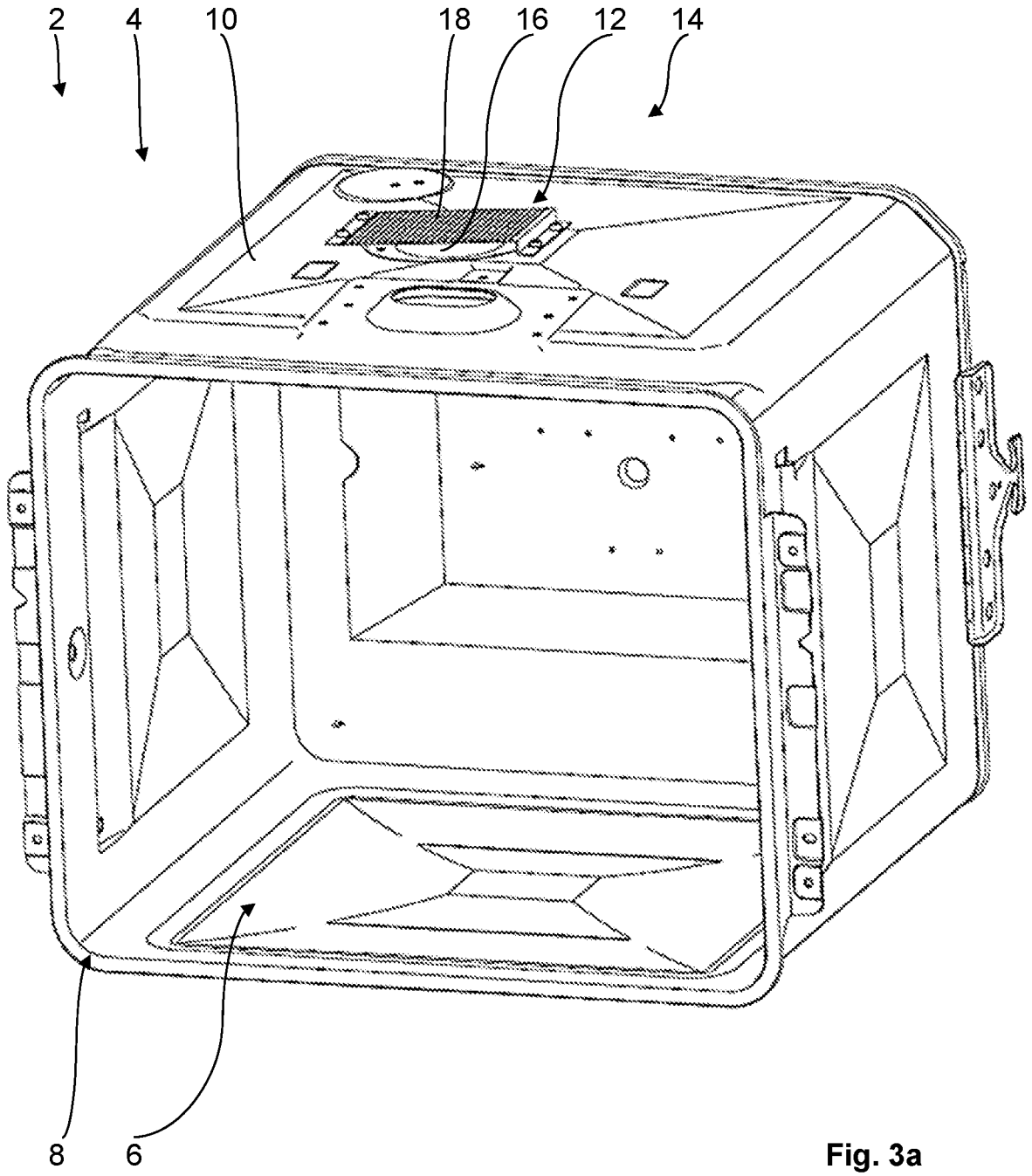
FIG. 3*a* shows a second exemplary embodiment of the cooking device according to the invention having the cooking device muffle according to the invention in a partial, perspective view, with the stop.
Figure 3B:
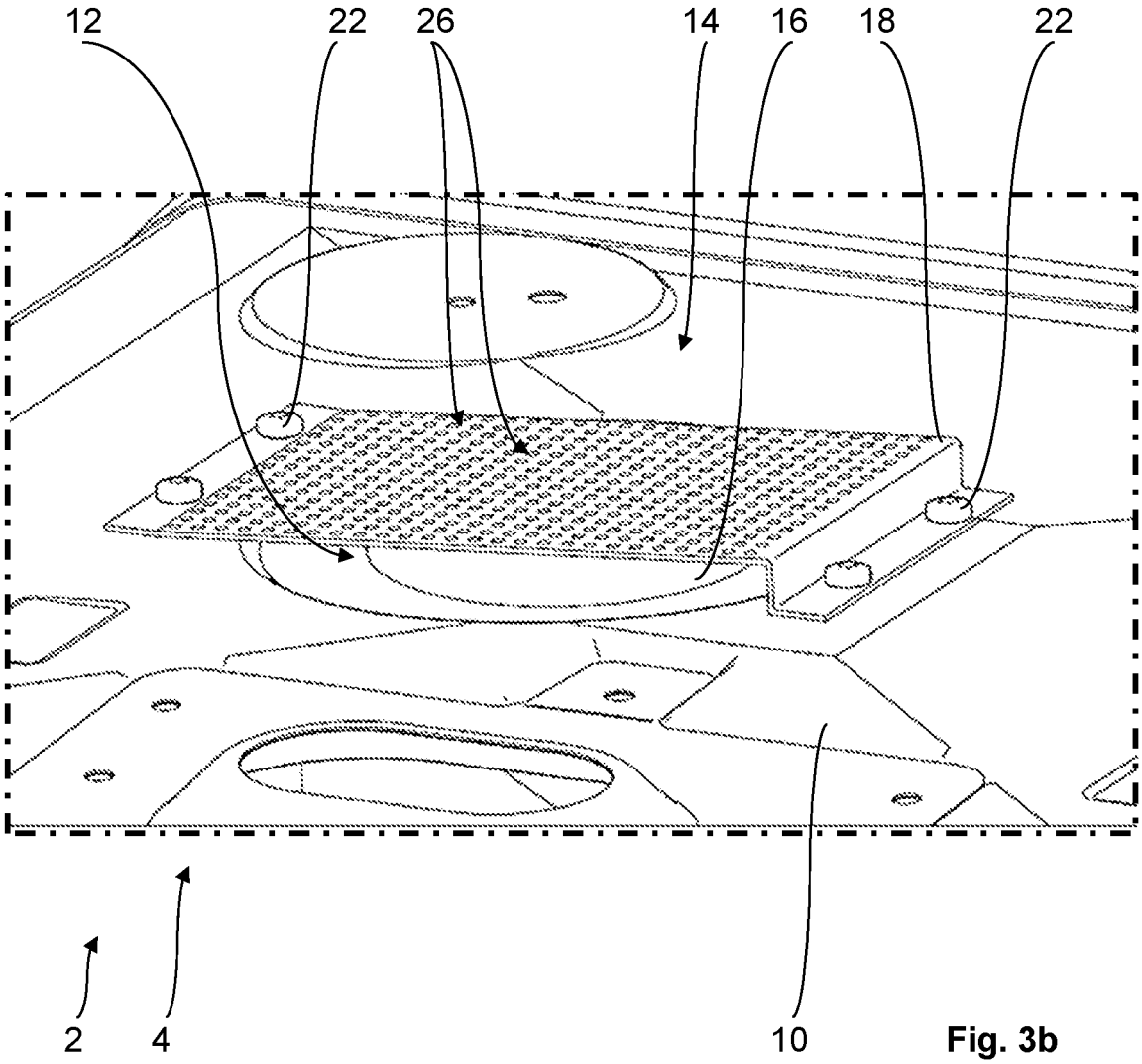
FIG. 3*b* shows the second exemplary embodiment according to FIG. 3*a* in an enlarged detail view in the region of the pressure compensation opening, in perspective view, with the stop.

FIGS. 3*a* and 3*b* show a second exemplary embodiment of the cooking device according to the invention having the cooking device muffle according to the invention. Identical components or components having identical function are provided with the same reference signs.

In contrast to the first exemplary embodiment according to FIG. 1*a* to 2*b*, in the second exemplary embodiment the stop 18 comprises a plurality of through-openings 26 on a side of the stop 18 opposite the pressure compensation opening 12, the plurality of through-openings 26 in this case being uniformly distributed over the entire aforementioned side of the stop 18, namely in such a way that a total area of the through-openings 26 corresponds to at least 10% of a total area of the aforementioned side of the stop 18. Otherwise, the second exemplary embodiment corresponds to the first exemplary embodiment, and therefore reference is made in all other respects to the above statements relating to the first exemplary embodiment.

In the following, the modes of functioning of the cooking device muffles according to the invention and the cooking device according to the invention, according to the present exemplary embodiments, are explained in more detail with reference to FIG. 1*a* to 3*b*.

Initially, the cooking device 2 having the cooking device muffle 4 is in the normal state shown in FIG. 1*a* to 3*b*, in which a cooking chamber pressure lower than the explosion pressure, namely 10 mbar, prevails in the cooking device muffle 4. The pressure compensation opening 12 is sealed tightly by means of the purely mechanical closing device 14.

For the purpose of an explosion test, the cooking device muffle is now sealed tightly as usual, namely by means of the door, and the cooking chamber pressure in the cooking chamber 6 is increased slowly from ambient pressure to the explosion pressure, namely 10 mbar.

As soon as a cooking chamber pressure of 10 mbar has been reached in the cooking chamber, the pressure compensation opening 12 is opened automatically by means of the closing device 14. Here, due to the explosion pressure prevailing in the cooking chamber 6, the closure cover 16 is lifted off the pressure compensation opening 12 against the spring force of the cover, so that the explosion pressure can be dissipated in a targeted manner from the cooking chamber 6 by means of the pressure compensation opening 12. The closure cover 16 here abuts the stop 18, so that it is ensured that the closure cover 16 can automatically close the pressure compensation opening 12 again by means of its spring force after a corresponding pressure drop in the cooking chamber 6.

After the cooking chamber pressure has been reduced in the aforementioned manner from the explosion pressure to a pressure value below the explosion pressure, i.e. below 10 mbar, the pressure compensation opening 12 is automatically closed again by means of the closing device 14 in the aforementioned manner. The cooking device muffle 4 is again in its normal state.

The aforementioned mode of functioning is identical in both exemplary embodiments. However, the second exemplary embodiment has, for example, the additional advantage that the pressure reduction in the cooking chamber 6 by means of the pressure compensation opening 12 can take place even more quickly due to the stop 18 provided with the through-openings 26.

Due to the design of the cooking device muffle 4 and cooking device 2 according to the invention, the explosion test suitability can be realized in a particularly simple and robust manner in terms of design and production. Accordingly, the cooking device muffle 4 and the cooking device 2 equipped therewith can be manufactured at considerably lower cost. By means of the two exemplary embodiments, the explosion test suitability is reliably ensured, so that damage or preliminary damage to the cooking device muffle 4 and/or to a remainder of the cooking device 2 is effectively prevented. For example, the explosion pressure associated with the explosion test can thus be kept away from the door of the cooking device 2 by means of which the cooking chamber opening 8 can be closed.

The invention is not limited to the present exemplary embodiments. See, for example, the explanations in this regard in the introduction to the description.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cooking device muffle for a cooking device, comprising:

a cooking chamber having a cooking chamber opening closable by a door of the cooking device, and at least one cooking chamber wall for delimiting the cooking chamber, wherein a pressure compensation opening is arranged in one cooking chamber wall of the at least one cooking chamber wall to dissipate an explosion pressure generated during an explosion test, the pressure compensation opening being closeable by a mechanical closing device of the cooking device muffle in a normal state of the cooking device muffle, in which a cooking chamber pressure in the cooking device muffle is lower than the explosion pressure, wherein the closing device is configured to automatically open the pressure compensation opening at a cooking chamber pressure greater than or equal to the explosion pressure and automatically close the pressure compensation opening if the cooking chamber pressure drops to a value below the explosion pressure, wherein the closing device has a closure cover fastened to the cooking device muffle for closing the pressure compensation opening in the normal state of the cooking device muffle and a stop fastened to the cooking device muffle, the closure cover and the stop being matched to one another such that the closure cover closes the pressure compensation opening automatically by a spring return force of the closure cover if the cooking chamber pressure drops to a value below the explosion pressure, wherein the stop comprises a bracket that spans the pressure compensation opening and the closure cover and is clamped on both sides, and wherein the bracket rises continuously from a first clamping end of the bracket to a second clamping end of the bracket opposite the first clamping end, the first clamping end of the bracket lying on a same side of the pressure compensation opening as a clamping end of the closure cover clamped on one side.

2. The cooking device muffle of claim 1, wherein the closure cover comprises a spring tongue clamped on one side and having the clamping end and a free end.

3. The cooking device muffle of claim 1, wherein the stop has a plurality of through-openings on a side of the stop opposite the pressure compensation opening.

4. The cooking device muffle of claim 1, wherein the explosion pressure for the closing device is greater than or equal to 10 mbar.

5. A cooking device, comprising:

the cooking device muffle of claim 1.

6. The cooking device muffle of claim 3, wherein the plurality of through-openings is distributed uniformly over an entirety of the side of the stop opposite the pressure compensation opening.

7. The cooking device muffle of claim 6, wherein a total area of the through-openings corresponds to at least 10% of a total area of the side of the stop opposite the pressure compensation opening.

8. The cooking device muffle of claim 1, wherein the bracket rises continuously from the first clamping end to the second clamping end by a predetermined angular value.

9. The cooking device muffle of claim 1, wherein the bracket is fastened to the cooking device muffle by at least one screw.

* * * * *